United States Patent [19]

Brown

[11] Patent Number: 4,745,693

[45] Date of Patent: May 24, 1988

[54] SHOE WITH DETACHABLE SOLE AND HEEL

[76] Inventor: Randy N. Brown, 8300 Old Kings Rd. S., Apt. #47, Jacksonville, Fla. 32217

[21] Appl. No.: 12,370

[22] Filed: Feb. 9, 1987

[51] Int. Cl.[4] ..... A43B 3/24; A43B 13/36

[52] U.S. Cl. ..... 36/101; 36/15; 36/72 R; 36/100

[58] Field of Search ..... 36/101, 100, 15, 72 R, 36/69, 45, 129, 50

[56] References Cited

U.S. PATENT DOCUMENTS

| | | | |
|---|---|---|---|
| 2,200,080 | 5/1940 | Fein | 36/101 |
| 2,809,449 | 10/1957 | Smith | 36/101 |
| 2,891,329 | 6/1959 | Good | 36/72 R |
| 3,822,488 | 7/1974 | Johnson | 36/129 |
| 4,103,440 | 8/1978 | Lawrence | 36/101 |
| 4,267,650 | 5/1981 | Bauer | 36/101 |
| 4,628,622 | 12/1986 | McBarron | 36/50 |

FOREIGN PATENT DOCUMENTS

| | | | |
|---|---|---|---|
| 886591 | 7/1943 | France | 36/101 |
| 1140140 | 2/1957 | France | 36/101 |
| 874066 | 8/1961 | United Kingdom | 36/101 |

*Primary Examiner*—James Kee Chi

*Attorney, Agent, or Firm*—Arthur G. Yeager

[57] ABSTRACT

A shoe having an upper portion and a sole-and-heel portion which portions are releasably joined together by a circumferential zipper connection means.

8 Claims, 2 Drawing Sheets

SHOE WITH DETACHABLE SOLE AND HEEL

BACKGROUND OF THE INVENTION

This invention relates to a shoe, particularly an athletic shoe, having the sole and heel attached to the upper by means of a zipper connection running completely around the shoe.

It is well known that modern shoes of the athletic type are made in many designs and shapes, with the principal design differences found in the sole. There are tennis shoes, golf shoes, running shoes, jogging shoes, walking shoes, basketball shoes, soccer shoes, football shoes, among many other types. Each type has a different sole design which is supposed to provide the maximum efficiency for the game and the maximum comfort for the wearer. The uppers of these shoes in many instances are almost exactly the same. It is not surprising that the soles and heels of these shoes wear out much sooner than do the uppers. We do not make the most of using the uppers of shoes, since many are not fully used when the shoe is discarded because the sole is worn. While a new sole and heel can be attached to a leather upper by stitching or the like, such attachment does not apply to rubber soles, and the prior art has not found an acceptable method of attaching a new sole and heel to a light weight athletic shoe.

It is an object of this invention to provide a shoe with a circumferential zipper that is capable of attaching or detaching the sole and heel to or from the upper. It is another object of the invention to provide the opportunity of joining one upper to any of several sole-and-heel portions. Still other objects will become apparent from the more detailed description which follows.

BRIEF SUMMARY OF THE INVENTION

This invention relates to a shoe having a sole-and-heel portion and an upper portion, said two portions being releasably joinable to each other by a circumferential zipper connecting means.

In specific embodiments of this invention, the shoe is an athletic shoe having a light weight leather and/or fabric upper portion and a rubbery sole-and-heel portion; and a zipper encircling the shoe where the upper portion joins the sole and heel.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 2:
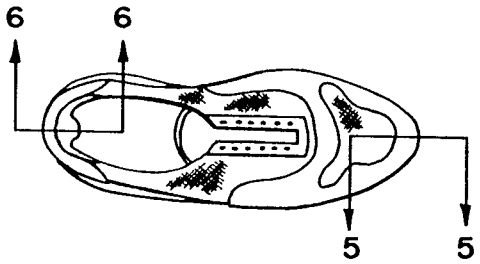
FIG. 2 is a top plan view of the shoe of FIG. 1.
Figure 1:
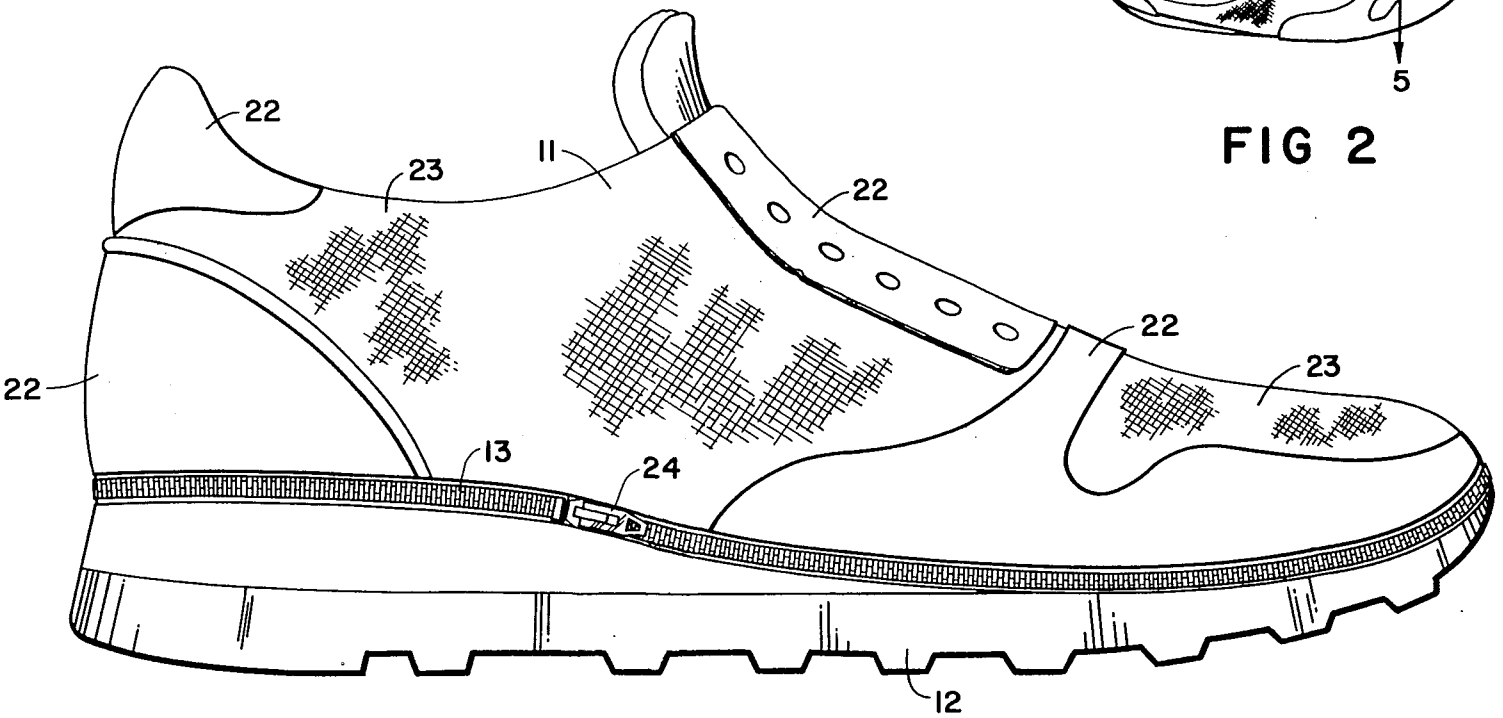
FIG. 1 is a side elevational view of an athletic shoe of this invention.

The invention is best understood by reference to the attached drawings. In FIG. 1 there is shown a typical tennis shoe having an upper portion 11 and a sole-and-heel portion 12. Upper portion 11 usually is made of a combination of soft thin leather or substitute leather parts 22 and fabric parts 23, usually nylon. The fabric parts 23 are included to provide better ventilation for the foot and to make the shoe as light weight as possible. Leather parts 22 are employed where the greatest wear occurs, due to bending, scuffing, holding laces, etc. The sole-and-heel portion 12 is normally made of rubber or rubber substitute with the bottom of portion 12 being formed of whatever design of tread or cleats or smoothness the shoe designer believes to be best for the intended use of the shoe. Of course, included in sole-and-heel portion 12 is the insole, arch support, and cushioning portions that underlie the foot.

The upper portion 11 and the sole-and-heel portion 12 are joined together by a zipper connection means 13 which extends completely around the shoe with the beginning and ends of the zipper in the mid-portion of the shoe and preferably on the arch side of the shoe, i.e., inside of each foot, so as to minimize any possibility of contact of the zipper slide 24 or zipper pull tab 21 with external objects of any type.

Figure 3:
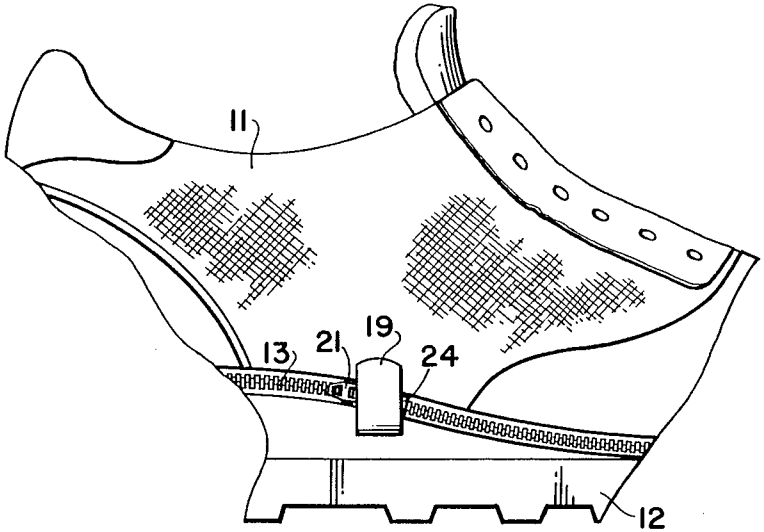
FIG. 3 is a partial side-elevational view of an athletic shoe of this invention having a keeper tab for the zipper connection means.
Figure 4:
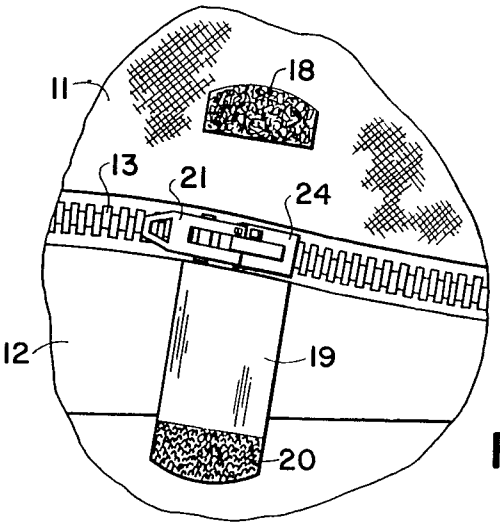
FIG. 4 is an enlarged view of the keeper tab of FIG. 3 in the open position.

Regardless of where the ends of zipper 13 may be located on the shoe, it is preferred to employ a self-locking zipper and a keeper tab 19 as shown in FIGS. 3 and 4. The self-locking zipper normally includes prongs or teeth on the pull tab 21 or on the slide 24 which are insertable into the teeth of zipper 13 to prevent slide 24 from sliding in either direction. The purpose of keeper tab 19 is to prevent slippage of the zipper pull tab 21 from flapping around causing problems. Tab 19 extends downwardly from the terminals of zipper 13 and is capable of being folded upwardly to cover zipper slide 24 and its pull tab 21. Any convenient form of releasable attachment for keeper tab 19 is operable, e.g., snap, "Velcro" patches. A patch 20 of fabric hooks is attached to the free end of tab 19 and a patch 18 of fabric loops is attached to upper portion 11 of the shoe. When used, tab 19 is merely folded upwardly and over slide 24 and pull tab 21 with patch 20 pushed onto patch 18. Tab 19 is attached to sole-and-heel portion 12. If a snap is selected rather than a "Velcro" fastener, one half of the snap is attached to upper portion 11 in place of patch 18 and the other half of the snap is attached to tab 19 in place of patch 20.

Figure 5:
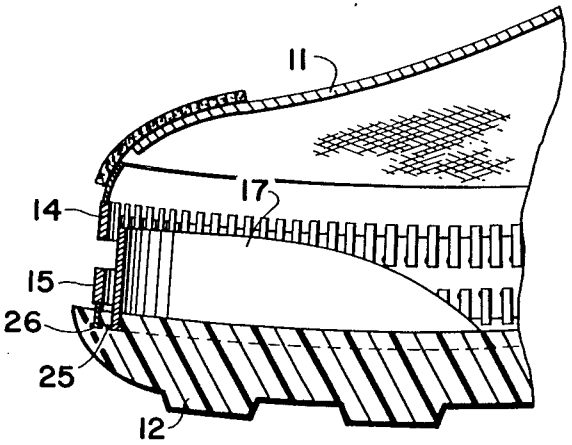
FIG. 5 is a cross sectional view taken at 5—5 of FIG. 2.

In FIG. 5 there is illustrated an optional feature wherein the toe of the shoe includes a toe barrier 17 between the toe of the person wearing the shoe and zipper 13. Toe barrier 17 is a semiflexible stiff strip of material such as polyethylene, nylon, or the like, permanently fastened to sole-and-heel portion 12 and placed just inside of zipper half 15 which is part of portion 12. Preferably barrier 17 includes a bead 25 which prevents barrier 17 from sliding out of the molded sole of portion 12. Barrier 17 may be inset molded when the sole is molded or attached to the sole later by being cemented into an appropriate groove in the sole. Zipper half 15 is similarly attached to the sole by bead 26. After zipper half 14 is closed upon zipper half 15 when upper portion 11 is fastened to sole-and-heel portion 12, barrier 17 will prevent the toe of the wearer from touching the zipper. This will provide comfort to the wearer who might otherwise have his or her toe irritated by rubbing against the zipper.

Figure 6:
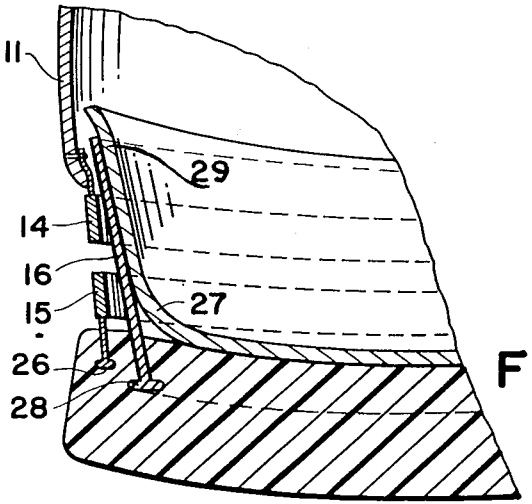
FIG. 6 is a cross sectional view taken at 6—6 of FIG. 2.

In FIG. 6 there is a similar barrier 16 shown to protect the heel of the wearer of the shoe. Heel barrier 16 is permanently attached to sole-and-heel portion 12 by bead 28 as described above with respect to barrier 17, and follows the contour of the zipper by being just inside of zipper half 15. The other zipper half 14 is attached by sewing, or otherwise, to upper portion 11. After the two zipper halves 14 and 15 are joined when the zipper is closed, heel barrier 16 will cover the zipper and prevent the wearer's heel from any possible contact with the zipper. Preferably, there also is included a soft form fitting insole 27 attached to portion 12 with a rear heel extension 29 to cushion the wearer's heel from contact with barrier 16.

It is to be understood that one upper portion 11 may be selectively attached to any of a number of sole-and-heel portions 12. Thus, a particularly comfortable upper portion 11 may be used with a tennis sole-and-heel portion, a golf sole-and-heel portion or others of such a nature. Similarly, it may be preferred to employ several different upper portions 11 which are of different designs, different color combinations, different heights, etc., with any of one or more sole-and-heel portions 12. Another advantage of the shoe of this invention is that it will facilitate cleaning of the shoe by washing, dry cleaning, or the like, since the two portions, 11 and 12, may be separated to permit access to all the inner sections of the shoe. Not only are athletic shoes envisioned for this invention, but also casual shoes, work shoes, dress shoes, or the like which may have leather uppers or leather soles.

Also, arcuate support 28 and toe support 17 function to insure that the zipper closure is made about the curved portions of the shoe and that the shoe retains its designed shape during repeated uses thereof.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a shoe assembly including an upper shoe portion having an elongated lower edge portion and covering an upper portion of a foot of a wearer and a lower shoe portion having an elongated upper edge portion and covering a lower portion of a foot of a wearer wherein said shoe assembly includes curved toe and heel portions the improvement comprising a releasable connecting means selectively attaching said lower edge portion to said upper edge portion, said releasable connecting means including a first means attached to and along said lower edge portion and a second means attached to and along said upper edge portion, said releasable connecting means providing positive attachment between said lower and upper edge portions which resists detachment from forces generally perpendicular to said lower and upper edge portions, said lower shoe portion includes an arcuate semi-stiff heel support, means for permanently attaching said heel support to said lower shoe portion with said heel support being upstanding therefrom, said heel support shielding a heel of a wearer from contact with said releasable connecting means, and said lower shoe portion including an arcuate semi-stiff toe support means for permanently attaching said toe support to said lower shoe portion with said toe support being upstanding therefrom, said toe support shielding toes of a wearer from contact with said releasable connecting means, said heel and toe supports providing ready closure and inward support of said releasable connecting means about said toe and heel portions and providing retention of shape of said shoe assembly during repeated uses thereof.

2. The shoe assembly of claim 1 wherein said releasable connecting means is a zipper having slide means to open or close said zipper and means to selectively prevent said slide means from moving.

3. The shoe assembly of claim 1 wherein said upper portion is defined by a soft flexible material in the form of an athletic shoe.

4. The shoe assembly of claim 2 wherein said lower portion is defined by an elastomeric material.

5. The shoe assembly of claim 2 wherein said zipper includes a starting end portion and an ending portion located medially of the length of said shoe assembly adjacent its arch portion.

6. The shoe assembly of claim 5 wherein said zipper includes a pivotable pull tab, further comprising detachable means for selectively locking said zipper pull tab in its locked position to inhibit inadvertent movement thereof tending to unzip said zipper.

7. The shoe assembly of claim 2 wherein said zipper includes a pivotable pull tab, which additionally includes a keeper strap at right angles to said zipper and located medially of the length of said shoe on the side adjacent its arch, said keeper strap being attached to said lower shoe portion, and means on said upper shoe portion to releasably attach said strap thereto. thereby releasably holding said pull tab snugly against said shoe assembly.

8. The shoe of claim 7 wherein said keeper strap and means on said upper shoe portion includes a fastener embodying fabric hooks and fabric loops.

* * * * *